United States Patent [19]

Nabulon et al.

[11] 4,453,298

[45] Jun. 12, 1984

[54] CONSTRUCTION OF THREAD TEXTURIZING NOZZLES

[75] Inventors: Werner Nabulon, Rudlingen; Armin Wirz, Ossingen, both of Switzerland

[73] Assignee: Rieter Machine Works, Ltd., Winterthur, Switzerland

[21] Appl. No.: 256,406

[22] Filed: Apr. 22, 1981

Related U.S. Application Data

[63] Continuation-in-part of Ser. No. 136,088, Mar. 31, 1980, abandoned.

[51] Int. Cl.[3] ..... D02G 1/12; D02G 1/16

[52] U.S. Cl. ..... 28/255; 28/272

[58] Field of Search ..... 28/255, 256, 272

[56] References Cited

U.S. PATENT DOCUMENTS

| | | | |
|---|---|---|---|
| 3,261,071 | 7/1966 | Clendening, Jr. et al. | 28/272 |
| 3,421,194 | 1/1969 | Breen et al. | 28/272 X |
| 3,823,450 | 7/1974 | Ankudowicz et al. | 28/272 |
| 4,188,691 | 2/1980 | Matsumoto et al. | 28/255 |
| 4,261,084 | 4/1981 | Kayser et al. | 28/255 |
| 4,268,940 | 5/1981 | Kuroda et al. | 28/255 |

FOREIGN PATENT DOCUMENTS

| | | | |
|---|---|---|---|
| 46-9856 | 3/1971 | Japan | 28/255 |
| 47-51664 | 12/1972 | Japan | 28/272 |
| 49-71242 | 7/1974 | Japan | 28/255 |
| 54-2450 | 1/1979 | Japan | 28/255 |

*Primary Examiner*—Robert Mackey

*Attorney, Agent, or Firm*—Kenyon & Kenyon

[57] ABSTRACT

A texturizing nozzle for synthetic filaments is openable and closable to facilitate lacing up. The nozzle comprises a two-part carrier structure with the parts movable towards and away from each other to open and close the nozzle. The thread path through the nozzle is defined by means of insert elements releasably mounted on the carrier structure at least in that region of the path in which the main texturizing step is performed. A thread infeed passage and a (preferably single) fluid infeed passage bring thread and treatment fluid together at a junction location, and a guide passage (which preferably widens in the downstream direction) leads the thread and fluid from the junction location to the texturizing region.

37 Claims, 11 Drawing Figures

CONSTRUCTION OF THREAD TEXTURIZING NOZZLES

This application is a continuation-in-part of U.S. application Ser. No. 136,088 filed Mar. 31, 1980, now abandoned.

The present invention relates to a thread texturizing apparatus comprising a texturizing nozzle through which the thread moves along a substantially predetermined path. The thread is subjected to a treating fluid, generally a gas or vapor, while passing through the nozzle. The term "thread" when used herein refers to any continuous textile element, particularly but not exclusively synthetic filamentary material, whether mono-filamentary or multi-filamentary.

Thread texturizing by means of a texturizing nozzle (or "jet") is well known—see for example U.S. Pat. Nos. 3,714,686 and 4,100,659 as examples only. These processes may operate on thread drawn from a bobbin, or upon thread received directly from a spinneret producing synthetic filament. In the latter case, there is a well known problem concerned with lacing of the continuously moving thread into the texturizing nozzle.

Openable and closeable nozzle structures have been disclosed in U.S. Pat. Nos. 2,938,257, 3,167,847, 3,261,071, 3,875,625, 3,800,371 and 3,237,269 as well as in U.K. Pat. Nos. 872,234 and 1,310,227. The nozzles are designed for a variety of purposes e.g. texturizing, bulking, entangling or simply forwarding thread.

None of the above-mentioned prior patents deals in any detail with a problem which is of special significance in nozzles required for processes, such as texturizing, which are relatively complex and which can have a significant influence on the properties and characteristics, e.g. the dyeability, of the thread material itself. In such nozzles, small variations in performance from nozzle to nozzle, or in a given nozzle over time, can produce noticeable variation in the characteristics of the thread. This leads at least to difficulties for the end user of the thread if not to production of poor quality goods from such thread e.g. woven material which exhibits "streaks" because of dyeing variations in the threads used. However, the achievement of controllable uniformity of operating characteristics of a series of manufactured texturizing nozzles raises very serious problems of accurate manufacture at acceptable cost levels.

It is already known to make up a thread passage through a thread treating nozzle by means of separately manufactured inserts assembled in a carrier body—see for example U.S. Pat. No. 3,849,846 where plate-like inserts are mounted between side members in a sandwich structure so as to define a thread passage of rectangular section. Replaceable inserts have also been suggested to enable modification of the performance of a nozzle—see for example U.S. Pat. Nos. 3,286,321 and 3,823,448 and U.K. Pat. No. 1,148,675. Still further, generally tubular inserts have been suggested to enable opening and closing of lace-up slots—see U.S. Pat. No. 3,800,371 as one example of many such.

Attention has also been paid to the way in which the thread and the texturizing fluid are brought together. For example, U.K. Patent Specification No. 1,487,328 deals with a diffuser chamber where the thread and fluid come together. It has further been suggested that the fluid infeed to the nozzle can be by way of an infeed "jet"—see for example jet 6 in U.S. Pat. No. 4,095,317. Generally, this is to enable accurate formation of the downstream, or tip, end of the jet as disclosed in U.S. Pat. No. 4,095,317 or U.S. Pat. No. 3,750,242.

Many other patents could be cited as showing the use of inserts for one purpose or another in a variety of nozzle constructions. Despite this multitude of prior art, however, the problems of reproduceability are so great and so dependent upon the individual texturizing process in question, that a manufacturer seeking to design a particular form of texturizing nozzle must deal with the individual problems associated with that nozzle and cannot seek significant general assistance from the prior art in this field.

The invention relates to a generally known type of thread texturizing nozzle for a generally known process adapted to texturize a thread by action of a treatment fluid thereon. The nozzle has a texturizing chamber in which the main texturizing action occurs. This chamber is elongated and defines one section of a thread path extending through the nozzle. The chamber has a perforated wall through which treatment fluid can leave the chamber generally transversely of the path. The nozzle also has means to bring together the fluid and the thread and lead them into the chamber. Prior to the texturizing chember, the fluid preferably exerts a forwarding action on the thread, urging it into the chamber, but this forwarding action is at least substantially reduced and may cease after the fluid enters the chamber due to the exit of fluid through the perforations. The chamber is designed to produce severe turbulence in the fluid therein and/or vibrations, possibly even at a resonance frequency. The fluid is preferably hot, in the form of a vapour or gas; air is preferred although steam may also be used. The temperature of the fluid and the residence time of the fluid and thread in the nozzle prior to entering the texturizing chamber, but after being brought together, are preferably such as to heat the thread to an approximately predetermined temperature dependent on the material of the thread and preferably close to the plasticizing temperature of the thread. The perforations in the chamber wall are preferably in the form of slits extending along and generally evenly distributed about the thread path.

Thread texturizing nozzles of the above general type, and in which the perforations in the chamber wall are provided in the preferred form of longitudinal slits, are shown in U.S. Pat. Nos. 3,714,686, 3,908,248, 3,950,831, 4,014,084 and 4,100,659 in the name of B.A.S.F., U.S. Pat. Nos. 3,983,610 and 4,095,317 to Akzona, German Published Specifications OLS 2,632,083 to Barmag and U.S. Pat. Nos. 3,802,038 and 3,849,844 to Neumünstersche Maschinen- und Apparatebau GmbH. Nozzles of the same general type but with different forms of perforation are shown in U.S. Pat. Nos. 3,576,059 to Glanzstoff, 3,482,294 to Rhodiaceta, 3,955,253 to Textured Yarn Co., 3,640,063 to BASF and in U.K. Pat. No. 1,487,328 to ICI. This list of patents, and the various forms of perforations suggested therein, are not intended to be exhaustive since the literature on this subject is extensive.

The object of the present invention is to modify the internal design of a texturizing nozzle of a particular, defined type to facilitate accurate manufacture to give controlled, repeatedly reproduceable characteristics of the textured thread.

The present invention in all its aspects relates to a thread texturizing nozzle for texturing a thread travelling in a generally straight path. The nozzle comprises means for bringing together a thread to be texturized and a treatment fluid at a junction location on the path;

a texturizing chamber defining a section of the path downstream from the junction location relative to the direction of movement of the thread through the nozzle, a perforated wall surrounding the chambers to permit fluid to pass out of the chamber in a direction transverse to the path; and a guide passage defining a section of the path between the junction location and the texturizing chamber.

Preferably, the nozzle comprises at least two carrier members, each adapted for mounting in a texturizing apparatus for movement into and out of a closed position in which the carrier members engage one another to enclose an open-ended elongated space containing the path.

Each carrier member may have releasably secured thereto at least one insert element which lies within the elongated space when the carrier members are in the closed position, the insert elements then engaging one another to form the texturizing chamber between them.

Each element may have a wall portion extending along the path and joined to at least one outwardly projecting support portion which engages a support surface of the associated carrier member within the space to hold the wall portion spaced from the carrier member. The open-ended texturizing chamber may be surrounded by an exhaust chamber provided by the part of the space outside the wall portions, there being perforations in the wall portions providing communication between the texturizing chamber and the exhaust chamber.

Each carrier member may have releasably secured thereto a plurality of insert elements which lie within the space when the carrier members engage one another. Thus, in addition to the insert elements forming the texturizing chamber, there may be an insert element defining a section of the path upstream from the junction location considered in the direction of movement of the thread.

The means to bring together thread and fluid may comprise a thread infeed passage opening onto said junction location and a single fluid infeed passage extending along an axis inclined at a small angle to the thread infeed passage and debouching onto the junction location.

The thread infeed passage is preferably offset to one side relative to the guide passage.

The guide passage preferable widens in the downstream direction.

By way of example, a two-part openable and closable nozzle according to the invention, together with variations thereof, will now be described with reference to the accompanying drawings in which.

Figure 1:
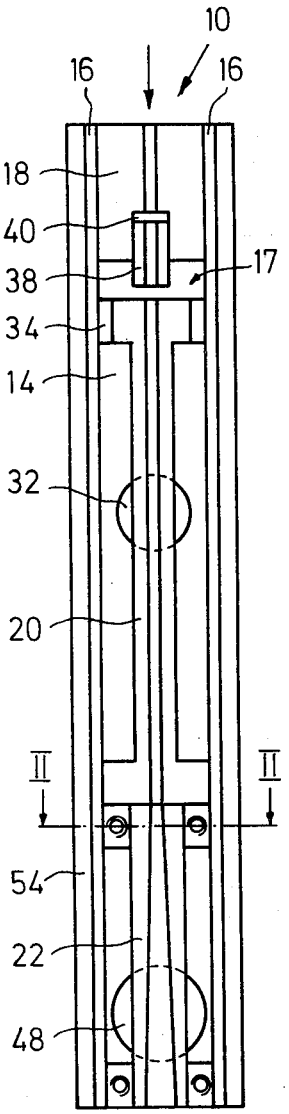
FIG. 1 is a front elevation of one of the parts.
Figure 3:
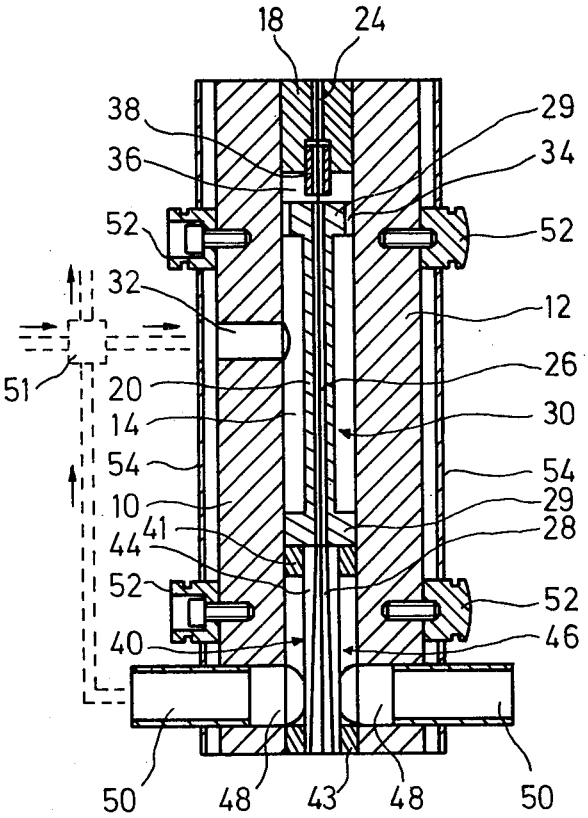
Figure 4:
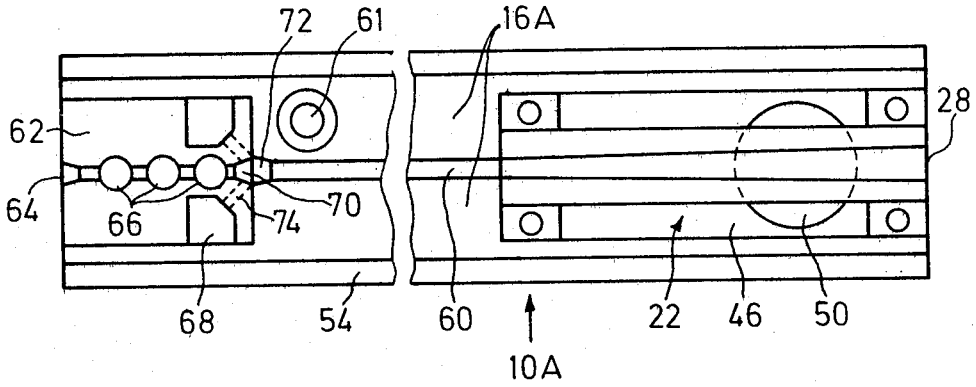
Figure 5:
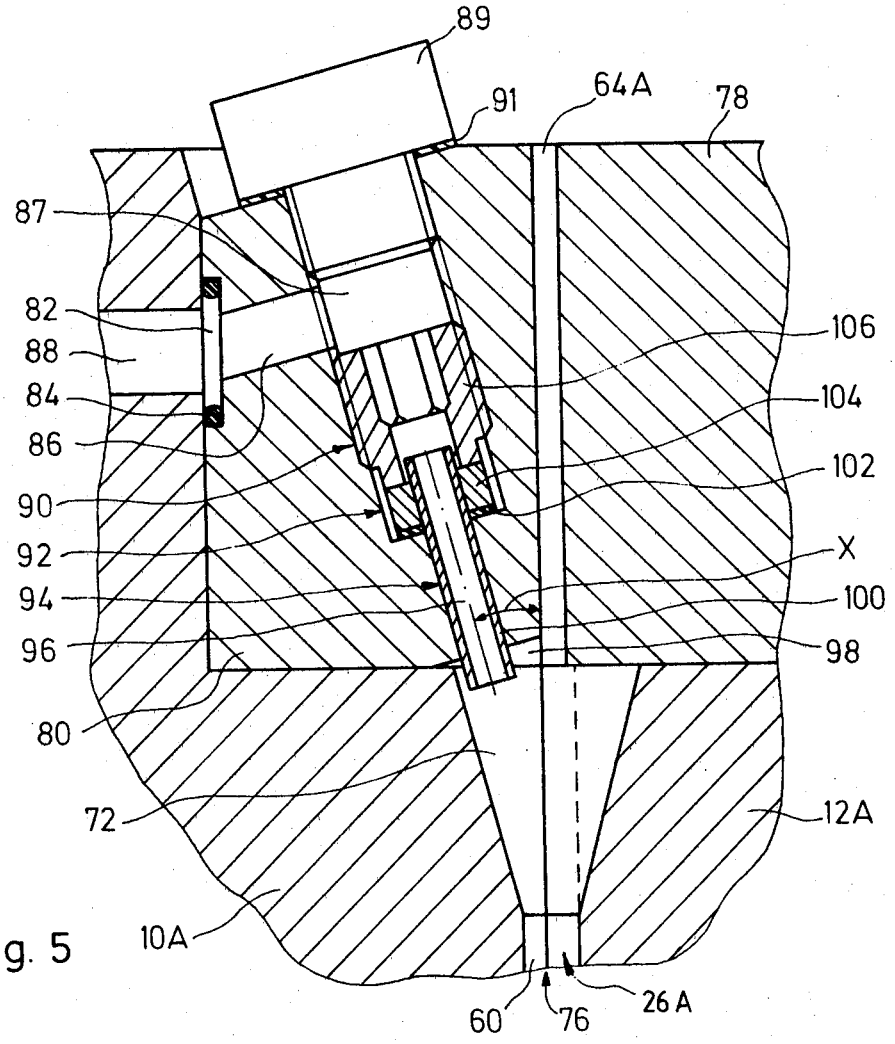
Figure 7:
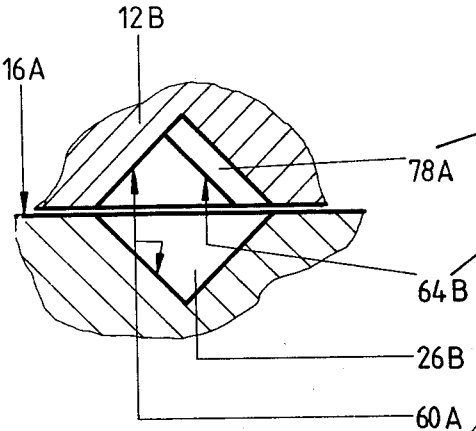
Figure 8:
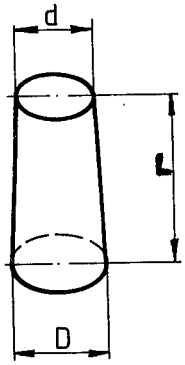
Figure 9:
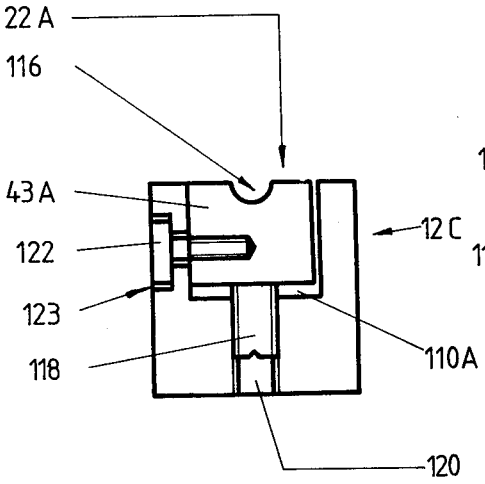
Figure 6:
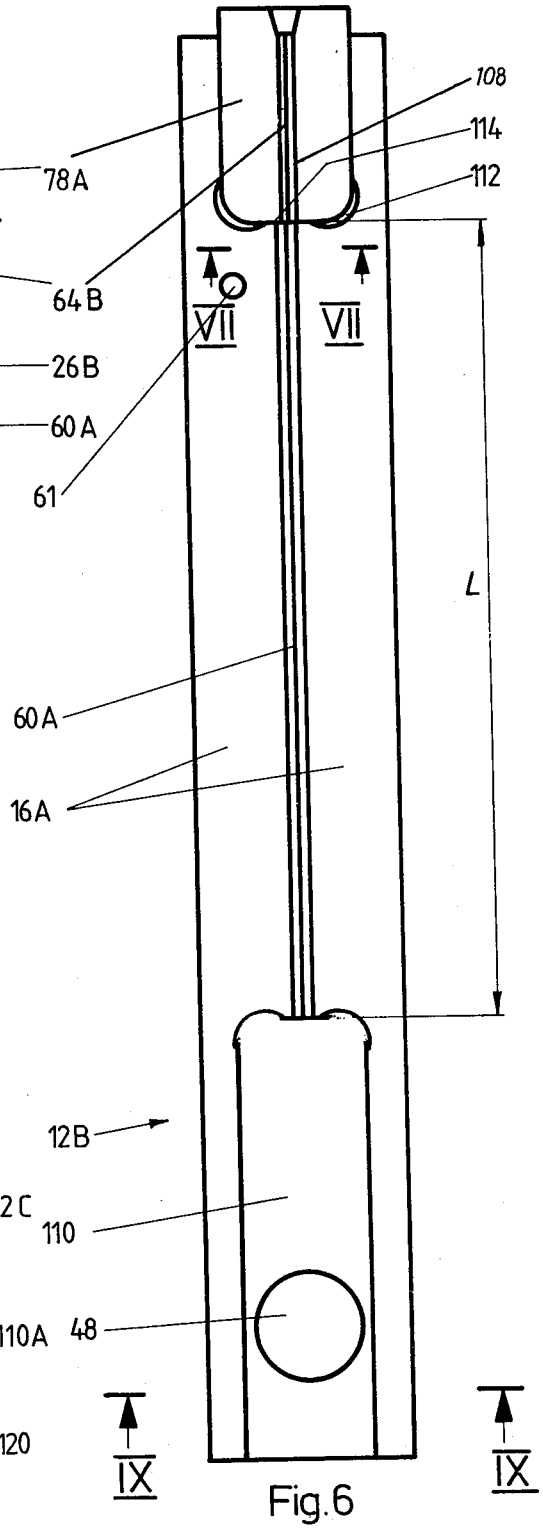
Figure 10:
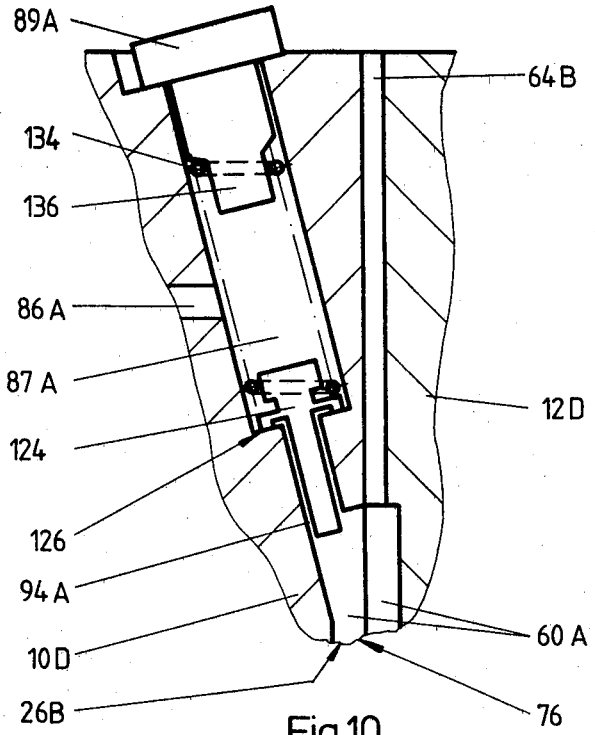
Figure 11:
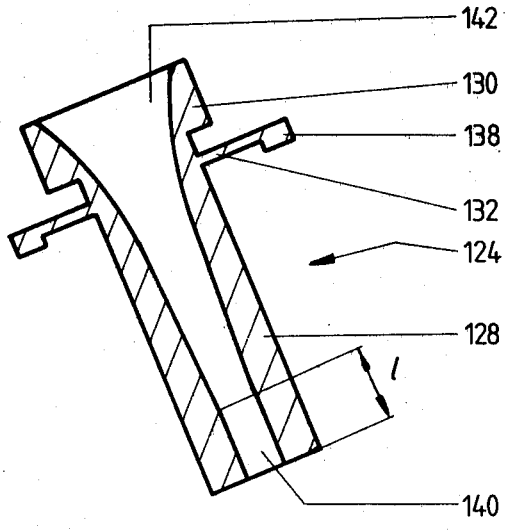

FIG. 3 is a side elevation in section of the complete nozzle using parts as shown in FIG. 1, FIG. 4 is a view similar to FIG. 1 of an alternative embodiment, FIG. 5 is a section through a portion of the embodiment shown in FIG. 4 but illustrating yet a further modification, FIG. 6 is a view similar to FIG. 4 of yet a further alternative embodiment, FIG. 7 is a partial section of the embodiment of FIG. 6, taken on the plane VII—VII indicated in FIG. 6 and showing the nozzle in the almost closed condition, FIG. 8 is a diagram for use in explanation of FIG. 6, FIG. 9 is a section through a modification of the embodiment of FIG. 6 and taken on the plane IX—IX in FIG. 6, FIG. 10 is a view similar to FIG. 5 showing a modification of the embodiment of FIG. 6, and FIG. 11 is a section through one element of FIG. 10, drawn to a larger scale.

Figure 2:
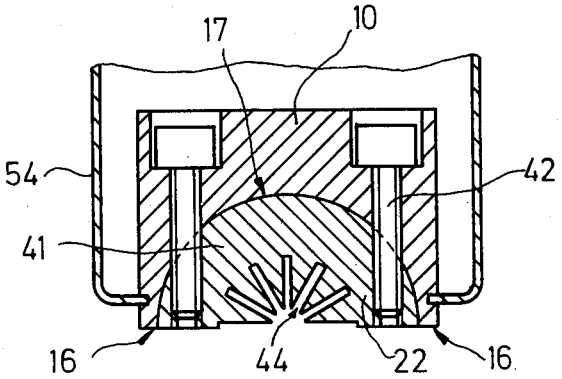
FIG. 2 is a section on the line II—II in FIG. 1.

The nozzle shown in FIGS. 1 to 3 comprises a metal body formed in two complementary parts 10 and 12, respectively (FIG. 3). Each part has plane surfaces 16 on either side of a groove 17. The surfaces 16 on part 10 can engage the surfaces 16 on part 12 in a sealing manner to provide a tubular body with a through bore 14 (FIG. 3) formed by the grooves 17. The sealing surfaces of the body part 20 are best seen in FIGS. 1 and 2 and there are similar surfaces on the body part 12. As will become apparent from the further description, each part 10 and 12 constitutes a carrier member for insert elements which in use lie in the open-ended elongated space provided by the through bore 14. The bore contains a thread path extending generally along the axis of the bore 14 and along which a thread to be textured is drawn in a downward direction as viewed in the Figures. The manner in which the thread path is defined will now be described. For convenience of description, reference will be made to "upward" and "downward" direction as viewed in the drawings, but it will be understood that the actual dispostions of the nozzle may be different in practice.

Each body part 10,12 contains three insert elements in its groove 17, the elements in the two parts being complementary in the same way as the parts themselves. Since the elements are the same in both body parts, only those in the body part 10 shown in FIG. 1 will be described in detail.

Considered in the direction of movement of thread through the nozzle in use (indicated by the arrow at the head of FIG. 1) the inserts comprise an infeed element 18, a guide element 20 and a texturizing chamber element 22. Each element is provided with a channel forming half of a central through bore, which defines the thread path in the complete nozzle assembly, together with sealing surfaces in the same plane as the surfaces 16. Thus, when the two body parts 10 and 12 are brought together, they form a first insert assembly comprising the insert elements 18 and defining a thread infeed passage 24 (FIG. 3), a second insert assembly comprising the insert elements 20 and defining a guide passage 26 and a third insert assembly comprising the insert elements 22 and defining a texturizing chamber 28. The infeed passage 24, guide passage 26 and texturizing chamber 28 together make up the thread path through the nozzle.

The guide elements 20 are such that the second insert assembly surrounding passage 26 comprises a central tube (the "guide tube") of smaller external diameter than the diameter of the insert—receiving bore 14, together with a pair of end flanges 29, engaging the wall of through bore 14 and locating the guide tube therein. Thus, a chamber 30 surrounds the guide tube and body part 10 is provided with a port 32 communicating with the chamber 30 so that in use treatment fluid can be fed into the nozzle via this port 32 and chamber 30. The upper end flange of the guide tube assembly is provided with openings 34 providing access for treatment fluid to a chamber 36 which process a communication chamber connecting the thread infeed passage 24 with the guide passage 26.

Each element 18 carries a sub-element 38 which is a press fit in and adjustable axially of a recess 40 provided in the element 18. Sub-elements 38 together provide the lower end section of the infeed passage 24, as viewed in FIG. 3. Thus, the axial spacing between the end of the infeed passage 24 and the beginning of the guide passage 26 can be adjusted by adjusting the axial position of the sub-elements 38. This spacing determines the amount of treatment fluid which is permitted to pass from the chamber 36 into the guide passage 26 along with the thread coming from the infeed passage 34. Thus, the infeed passage 24, chamber 36 and the fluid access channel, provided by port 32, chamber 30 and the openings 34, co-operate to provide means for bringing together the thread and the treatment fluid. The above described means for bringing together thread and fluid is generally in accordance with the prior art.

Each insert element 22 comprises a perforated wall in the form of wall portions 40 and flange portions 41, 43. Each flange portion fits neatly into the groove 17 in its body part 10 or 12, as best seen in FIG. 2, and is secured therein by screws 42. The wall portions 40 together make up a texturising chamber wall of external diameter smaller than the diameter of the through bore 14 and firmly supported at both ends by the end flanges provided at one end by the co-operating flange portions 41 and at the other end by the co-operating flange portions 43. The tubular wall made up by wall portions 40 has twelve longitudinally extending slots 44. As best seen in FIG. 2, each insert 22 contains five full slots and two additional slots are formed at the interface when the elements 22 are brought together in the closed nozzle. Each slot 44 extends from end to end of the respective element 22, i.e. through both end flanges, and passes radially completely through the wall between the connecting end flanges. These slots enable communication in use between the texturising chamber 28 and a further chamber 46 provided around the wall portions 40 by the bore 14. The preferred number of slots lies in the range of from 10 to 14.

Thus, the length of bore 14 between the downstream end of guide passage 26 and the downstream end of the bore itself constitutes a cavity which is divided by the wall portions 40 into a texturizing chamber 28 surrounded by an exhaust chamber 46. Each body part has a port 48 communicating with this chamber 46 and in use outlet passages 50 are connected to respective ports 48 to lead away treatment fluid, and any vapor produced from pretreating preparations applied to the thread, passing into the chamber 46 from the chamber 28. The removal of treatment fluid and vapor from chamber 46 is effected in a controlled fashion by a suitable suction device (not shown) connected to passages 50 and drawing the treatment fluid and vapor away to a suitable exhaust location. In use, these passages 50 may pass the treatment fluid through a heat exchanger diagrammatically shown at 51 so that the waste fluid transfers at least part of its heat to the incoming fluid being fed to the port 32.

Each body part is also provided with studs 52 enabling it to be mounted on an appropriate support structure (not shown) of a texturizing apparatus, the receiving members on the support structure being relatively movable to enable opening and closing of the nozzle. A suitable system for enabling this is described in copending Patent Application Ser. No. 81,051 filed Oct. 2, 1979. Each body part is also partially enclosed by a casing 54 of a material of low heat conductivity so as to protect operators from the hot metal of the body parts 10 and 12 in use.

FIG. 4 shows a first modification of the embodiment of FIG. 1, namely the elimination of the insert elements 20. The guide passage in this embodiment is provided by two grooves 60, only one of which is of course seen in the frontal view of FIG. 4. These grooves are of small cross section relative to the grooves 17 shown in FIG. 1 and they are provided directly in the material of the body part 10 A (or 12A) with sealing surfaces 16A being provided to either side. The larger sealing surface enables inclusion of a recess 61 to receive a guide in the other body part. At each end of the groove 60, there is an enlarged groove portion forming upstream and downstream cavities when the body parts are brought together with their faces 16A in sealing contact. The downstream cavity contains an insert assembly made up of inserts essentially the same as the inserts 22 of FIG. 1 and forming a texturizing chamber 28 and an exhaust chamber 46 as already described. The means for bringing together the fluid and the thread differs from that shown in FIGS. 1–3 and will now be described.

The upstream cavity also contains an assembly of insert elements 62 co-operating to define a thread infeed passage constituted by grooves 64. Each groove 64 has three widened sections 66 which help to form a labyrinth seal hindering back flow of treatment fluid along the thread infeed passage. However, these sections 66 can be omitted if desired. The external surface of each element 62 has a groove 68 so that in the nozzle assembly these grooves form an annular channel surrounding the thread infeed passage. One of the body parts is provided with an infeed port (not shown) enabling supply of treatment fluid to the channel thus formed.

The downstream end of the thread infeed passage has a frusto-conical widening 70 facing a corresponding widening 72 on the upstream end of the guide passage formed by the grooves 60. A selected number of fluid infeed bores 74 extend between the channel provided by grooves 68 and the widening 70 so as to direct fluid into the widening on the guide passage. The widened portions 70, 72 thus together constitute a junction chamber where the thread and treatment fluid are brought together before passing onwards into the guide passage. FIG. 4 illustrates two bores 74, giving a total of four assuming that the other body part 12A is the same in this respect. This is however not the preferred arrangement, one embodiment of which will now be described with reference to FIG. 5.

FIG. 5 shows a section through the infeed end of the nozzle, the section being taken at right angles to the frontal view shown in FIG. 4, so that both body parts 10A and 12A, and the join line 76 between them, are visible. Each groove 60 is of triangular cross section, so that the complete guide passage 26A is square in section. The thread infeed passage 64 A is now provided by a simple, triangular section groove in the insert element 78 in the body part 12A only i.e. the facing surface on the insert element 80 in the body part 10A is now planar. There is no external groove in the element 78 similar to the groove 68.

There is also no external groove in the insert element 80, but instead the latter has a recess 82 containing an O-ring 84 encircling the access port of a bore 86. Recess 82 opens in the complete assembly onto a fluid supply passage 88 suitably provided (in a manner not shown in detail) in the body part 10A. Bore 86 leads fluid from supply passage 88 to cavity 87 the upper portion of which, above the bore 86, opens onto the end-face of element 80 and is screwthreaded to receive a closure screw 89 with a sealing washer 91. This opening, provided by the upper portion of the cavity, is provided simply to enable access to the lower portion now to be described and is blocked off in normal use by the screw 89 or any other convenient closure means.

The lower portion of the cavity, below bore 86, comprises a screw threaded section 90 and a further section 92 which is not screw threaded. A bore 94 of relatively small cross section provides a communication passage leading from section 92 to a recess 98 formed in the bottom surface of the element 80, and facing into the widening 72 formed on the upper end of the guide passage. The angle X between the axis of the bore 94 and the adjacent side surface of the element 80 is made as small as practicable.

The bore 94 contains a tube 100 which is secured therein by any convenient means. The illustrated securing means comprises an elastomeric compressible washer 102 clamped between an annular end surface of the cavity 87 and a bush 104. The latter can be urged towards the end surface of the cavity to squeeze the washer against the outer surface of the tube 100 by means of a tubular nut 106 in the screw threaded cavity section 90. Fluid flow communication between the bore 86 and the tube 100 is provided by the interior of the nut 106. The tube is so held relative to the insert element 80 that it will just project into the widening 72. Clearly, positive means could be provided on a tube of definite length to ensure its location in a desired position relative to insert element 80. The bore 96 of the tube 100 constitutes the only fluid infeed passage in this embodiment and the element 80 in this case performs the additional function of acting as a receiver element for the fluid infeed tube 100, the latter being releasably secured in its receiver by the securing means referred to above. The latter comprises sealing means, in this case washer 102, to ensure that all infeed fluid must pass through the tube 100.

In the embodiment of FIG. 5, the bore configuration of tube 100, and especially the dimensions of the cross section of passage 96, are chosen to provide a desired infeed rate of treatment fluid at a given pressure. By substituting a tube 100 having a different effective cross section for the passage 96, the user can vary the fluid infeed rate. The tube 100 can be changed via the access opening at the upper end of cavity 87 when the closure screw 89 has been removed. The degree of control obtainable over the infeed rate by means of such tubes is so high that external adjusting controls, such as a throttle in the infeed to the passage 88, can be dispensed with, although this aspect of the invention is not of course limited to use of the flow control tubes 100 without any external control over the infeed rate. Thus, each nozzle preferably has an associated set of flow control tubes 100 of different bore configurations i.e. different dimensions of bore cross section and/or different tube length and/or different bore shape.

The bore through each tube 100, providing the passage 96, is preferably circular in cross section. The illustrated tube is of uniform cross section along the full length of the tube, but this is not essential. The length of the tube is preferably chosen in relation to the other operating conditions e.g. type of treatment fluid, supply pressure, etc. to give a directed flow of fluid from the downstream end of the tube with minimum turbulence. A relatively short orifice-type control is unsuitable for this purpose because it creates uncontrollable flow disturbances both at the upstream side and at the downstream side of the orifice and such disturbances prejudice the achievement of uniform texturizing conditions both over time and between different nozzles. Also, to avoid undue disturbance in the transfer of fluid from the tube 100 to the guide passage provided by the grooves 60, the tube is aligned as close as possible to the line of the guide passage i.e. angle X is chosen as small as possible and the thread infeed passage 64A is provided in the element 78 only. Also to facilitate disturbance free transport of fluid to the guide passage, the junction region provided by widening 72 may be in the form of a tapering chamber narrowing towards the guide passage as illustrated, although the widening in the body part 12A could be omitted as indicated by the dotted line.

By way of example only, the following dimensions of various elements of an embodiment according to FIG. 5 are quoted Treatment Fluid—Hot Air
Supply Pressure in cavity 87—6 bar
Length of Tube 100—12 mm
Angle X—15°

| Diameter of Circular Passage 96 | Infeed Rate |
|---|---|
| 1.2 mm | 3.2 $Nm^3/h$ ($M^3$ S.T.P.) |
| 1.4 mm | 4.5 $Nm^3/h$ ($M^3$ S.T.P.) |
| 1.6 mm | 5.2 $Nm^3/h$ ($M^3$ S.T.P.) |

Preferably the angle X is not greater than 30° and an angle X less than 20° is highly desirable. Due to production problems, it will not usually be possible to obtain an angle X much less than 10–12°. Preferably, the minimum length of tube 100 is 0.4 cm and the preferred length is in the range 0.6 cm to 3 cm.

The lower end of the tube 100 preferably comes as close as possible to the line of the thread path through the nozzle without risking contact between the tube and the thread in use. The tube may be provided with means, e.g. a flange at a location spaced from both ends of the tube to ensure that the downstream end is accurately located relative to thread path e.g. bush 104 may be secured to or integral with tube 100.

As illustrated, it is preferred not to feed treatment fluid to the tube 100 via the closure screw 89—this could be done by providing a passage through the screw but it would complicate the tube exchange procedure since it would be necessary to disconnect the fluid supply from the screw and/or to provide flexible fluid supply leads, to enable the screw to be removed to provide access to the tube. The alternative possibility, of replacing the tube via the downstream end of bore 94 after removal of the insert element 80, is far too complex. Also, the provision of a series of insert elements with unlined bore sections 94 of varying diameter i.e. eliminating the liner tube 100, is relatively costly.

The thread path through the nozzle is preferably straight and the fluid preferably joins the thread path from an infeed passage at a, preferably small, angle thereto. The reversal of this relationship, as shown in U.S. Pat. No. 3,983,610, makes the division of the nozzle, for opening and closing purposes, extremely complex with the risk of very high wear on the nozzle, and disturbance in the system, at the location where the thread path bends to join the straight fluid flow path.

Exchangeable liner tubes, such as tube 100 shown in FIG. 5, could of course be used in one-piece texturizing nozzles or in a texturizing nozzle which is divided, for example as shown in the co-pending Patent Application Ser. No. 81,051, filed Oct. 2, 1979 but which does not have insert assemblies at the infeed end and/or outfeed end.

The embodiments illustrated in FIGS. 1 to 5 offer the following advantages over the prior art 1. In relation to the texturizing chamber:

(a) the interior of each insert element 22 is readily accessible so that both the groove providing the internal surface of the texturizing chamber, and the slots through the chamber wall can be produced economically but with a high degree of accuracy:

(b) the ends of the insert elements are of solid construction, due to the incorporation of the end flanges, and are firmly supported because of the contact of each end flange with the adjacent surface of the carrier part 10 or 12—this as advantageous in reducing uncontrollable vibration at both ends of the texturizing chamber, such vibration being particularly disadvantagous at the upstream end of the texturizing chamber and particularly prone to occur at the downstream end where the body defining the texturizing chamber is often of weak construction and relatively poorly supported:

(c) the carrier members are conveniently used to enclose the texturizing chamber, thus obtaining the increased safety, reduced noise and, possibly, the improved economics which can be obtained from such enclosed texturizing chambers:

(d) should the texturizing chamber insert elements be damaged or for some other reason fail to perform satisfactorily in service, or should it be desired to change the texturizing process, then the relevant element(s) 22 can be exchanged without requiring exchange of the complete nozzle—similarly, should an error occur during the complex process of production of such an insert element, then only that element must be rejected, thus reducing production waste.

2. In relation to the infeed section: the main difficulties in this section are the regulation of the quantity of treatment fluid fed into the nozzle and the avoidance of uncontrollable disturbance in the system, such as turbulence. Both of these factors are highly dependent upon the accuracy with which the infeed section of the nozzle can be produced and hence advantage (a) given above for the texturizing chamber is relevant again here—likewise advantage (d). The advantages of an assembly of inserts are obtained in all three illustrated embodiments (FIG. 1, FIG. 4 and FIG. 5). However, additional advantages are obtained from the embodiment in FIG. 5 because of the relatively simple structure shown there. All of the fluid infeed passes through a single passage which can be manufactured accurately outside the complete assembly. It is only necessary to align this one passage accurately relative to the guide passage 60 and thread infeed passge 64A—contrast the four infeed passages in the embodiment of FIG. 4. Further, replacement of the liner 100 by a tube of different effective cross section in the flow passage 96 enables simple adjustment of the texturizing characteristics while the ability to form each passage 96 very accurately ensures accurate control over the infeed of treatment fluid without requiring complex adjustment systems outside the nozzle.

3. In relation to the guide passage: here the advantages of inserts are less pronounced and to avoid the necessity to form the external surface of each insert to co-operate with its carrier part, it is preferred to build the guide passage into the carrier itself as shown in FIGS. 4 and 5. However, in some cases it may be desirable for temperature control reasons to surround the guide passage with hot fluid, as in FIGS. 1 to 3. Whether or not the guide passage is provided in an insert, the non-curvilinear internal surface on the guide passage is preferred, as the straight sides tend to reduce turbulence.

A range of embodiments has already been illustrated to show that modifications are possible within the scope of the invention. Further modification is possible within the scope of the invention. For example, the exchangeable liner tubes such as tube 100 could have a slightly conical bore instead of a bore of uniform circular cross section as illustrated. The bore would taper in the flow direction, i.e. narrowest cross section at downstream end, with a small half angle, i.e. angle between the axis of the bore and a straight line lying in the internal surface of the tube. The maximum practical half angle would be about 5°. This conical formation of the infeed tube would reduce air speed at the upstream end of the tube, giving lower losses through friction, while still giving adequate air speed at the downstream end. Further modifications will now be described with reference to FIGS. 6 to 11.

FIG. 6 illustrates a modification of the embodiment shown in FIG. 5. In this case, the body part 12B is seen in plan view similar to the view of the body part 10A shown in FIG. 4. The non-thermally-conductive cover 54 (in FIG. 4) has been omitted from FIG. 6. Again, the same or similar reference numerals have been used to indicate similar parts. Only the major modifications over FIGS. 4 and 5 will be described in the following.

The first modification concerns the guide passage constituted in the completed nozzle by the grooves 60A. In the embodiment of FIG. 6, the cross sectional area of this passage increases uniformly in the downstream direction, that is from the upper end of the passage to the lower end as viewed in FIG. 6. The junction location, at which the thread and fluid are brought together, is now provided by the uppermost section of the guide passage but there is no enlarged "junction chamber" similar to that shown at 72 in FIG. 5. The widening of the guide passage in the embodiment of FIG. 6 will be referred to for convenience as a "conical" widening, although each groove 60A is triangular in cross section so that the guide passage itself is square in cross section, as in the embodiment of FIG. 5.

The "conical" formation of the guide passage enables use of a higher velocity of treatment fluid at the infeed end of the guide passage and an increased forwarding effect of the treatment fluid in the guide passage taken as a whole, that is, an increased tension in the thread upstream from the nozzle. This improves the running of the thread upstream from the nozzle. However, it is found that above a certain degree of widening, which degree will be discussed further below, no further improvement in running performance is observed.

The widening of the guide passage also leads to improved "opening" of a multi-filament thread before the latter enters the texturizing chamber. This enables more effective action of the treatment fluid on the individual filaments both to transport them (forward them) along the guide passage and to texturize them in the chamber.

The desirable degree of widening in the guide passage will now be discussed with reference to the diagram of FIG. 8.

For convenience, the guide passage is represented as a frusto-cone. The cross sectional area of the upper axial surface of the frusto-cone (of smaller diameter d) is equal to the cross sectional area of the guide passage at its upstream end. Similarly, the cross sectional area of the lower axial surface of the frusto-cone (larger diameter D) is equal to the cross sectional area of the guide passage at its downstream end. The length L between the axial surfaces of the frusto-cone is equal to the length L of the guide passage. The degree of widening of the guide passage can then be represented by a corresponding number derived from the diagram of FIG. 8, as follows $$E=[(D-d)/L]\cdot 100\%$$

where E is the required degree of widening, expressed as a % of length L.

We have found that the running performance of the thread improves as the degree of widening is increased from 0 to about 1.0% . The degree of widening can be increased beyond this value without detracting from the performance of the texturizing chamber. Values of at least 1.2% are achievable without so detracting from the performance of the texturizing chamber. However, we have found that usually the most significant improvement has been achieved when the degree of widening lies in the range 0.6 to 0.7% and higher values may make it difficult to match the guide passage cross section to the texturizing chamber cross section.

The widening shown in the drawings is both smooth and uniform, and it takes place over the full length of the guide passage. Discontinuities in the surface bounding the guide passage, e.g. as produced by stepped widening, are liable to introduce flow disturbances and may therefore be found undesirable. A varying rate of smooth widening along the length of the guide passage is acceptable, but requires a relatively complex formation step and may be difficult to reproduce accurately in different nozzles. The widening could occur along part only of the length of the guide passage, but preferably extends from one end thereof to the other as this widening enables a higher average velocity of the treatment fluid taken along the guide passage as a whole.

The widening shown in FIG. 8 can of course be used also in the embodiments shown in FIGS. 3 and 5.

Although it is not clearly apparent from FIG. 6, the thread infeed passage 64B, provided by a groove in the infeed insert element 78A only, also varies in cross-section along its length. Widening does not occur along the full length of the thread infeed passage, however, but only upstream from a point indicated by the numeral 108 in FIG. 6. From the point 108 to its downstream end, the thread infeed passage is of uniform cross-section, of the minimum value consistent with infeed of the desired thread without interference. Thus, flow of treatment fluid "backwards" along the thread infeed passage is minimized. Any treatment fluid which does leak backwards along the thread infeed passage will have a "reverse forwarding" effect, i.e. an effect in opposition to the forwarding of the thread in the guide passage. It is desirable to reduce this "reverse forwarding" effect as far as possible, and this can be achieved by the widening of the thread infeed passage referred to above. If the degree of widening of the thread infeed passage is represented by a frusto-cone similar to that shown in FIG. 8, then a degree of widening consistent with a cone half angle in the range 2–5° will generally be found satisfactory.

FIG. 7 illustrates more clearly a further modification of the embodiment of FIG. 6 when compared with that of FIG. 5, namely that the thread infeed passage 64B is "offset" relative to the guide passage 26B made up by the two grooves 60A, that is, the thread infeed passage 64B and the guide passage 26B have no common plane of symmetry. As viewed in FIG. 7, the longitudinal center line of groove 64B is displaced to the left of the longitudinal center line of groove 60A in body part 12B; the displacement, which is not clearly apparent in FIG. 6, is to the right in that Figure, because the nozzle part is there viewed in underplan when compared with FIG. 7. As a result of this transverse offset of the thread infeed passage relative to the guide passage, the thread is urged to one side of the guide passage by the inflowing airstream i.e. to the left hand side as viewed in FIG. 7. The offset should be so disposed relative to the fluid infeed passage that the incoming fluid assists in moving the thread to one side. In the arrangement of FIG. 5, in which the thread infeed passage is disposed symmetrically with respect to the longitudinal center line of the guide passage, it is found that the thread is urged sometimes to one side, sometimes to the other and sometimes towards the apex of the thread infeed passage. This tends to increase the degree of variability of the texturizing process both over time in one nozzle and as between nozzles of a complete installation.

The texturizing chamber insert element has been omitted from FIG. 6, so that the downstream cavity 110 is seen as a whole in that Figure. Part of the upstream cavity 112 can also be seen in FIG. 6, although the infeed insert element 78A is located in its operative position in that cavity. In the FIG. 6 embodiment, a rebate is formed at the lower end of the cavity 112, so that the insert element 78A makes sealing contact with the body part 12B on a relatively limited sealing surface 114 surrounding the thread infeed and guide passages. A similar rebate is formed at the upper end of the cavity 110.

The cavity 110 in FIG. 6 is generally similar to the corresponding cavity in FIG. 4 and could receive a similar insert element 22. However, the design of the insert elements can also be changed from that shown in FIGS. 1 to 4. For example, the slots 44 may be replaced by holes extending radially through the wall-portion of each insert. Such a structure is inherently more rigid than a structure comprising a plurality of slots, and it may therefore be possible to eliminate, wholly or partly, the support flange from the upstream end of the insert. The insert would still make sealing contact with the body part 12B on an axial surface surrounding the guide passage and the entrance to the texturizing chamber, but each insert element would be secured and supported only adjacent its downstream end. If the upstream flange is only partly eliminated, the downstream flange may still provide the only securing/supporting means, but the remaining part of the upstream flange can reinforce the structure against undesired vibration.

FIG. 9 illustrates a modification of FIG. 6 using a modified texturizing insert assembly as referred to above. The body part 12C has a square or rectangular section cavity 110A, and each texturizing chamber insert element 22A has a correspondingly shaped flange 43A at its downstream end. Insert element 22A also has a circular-section groove 116, which in the complete nozzle is aligned with a similar groove in a complementary body part 10C (not illustrated) to define a texturizing chamber. Although not visible in FIG. 9, insert element 22A also has a wall-portion similar to wall-portion 40 of the insert element 22, but the perforations in insert element 22A are provided by holes of circular or other convenient section extending radially through the wall-portion and each of relatively small dimensions relative to the length of the insert. Insert element 22A may have a reinforcing flange at its upstream end, or the sealing surface at the upstream end may be provided simply by the axial end surface of the wall-portion. In any event, insert element 22A is secured and supported in the cavity 110A only at its downstream end, by adjusting means now to be described.

As clearly seen in FIG. 9, insert 22A is supported clear of the base of the trough-like cavity 110A by means of one or more adjusting screws 118 engaging the flange 43A. The screws 118 extend through suitable screw-threaded openings 120 formed in the body part 12C. Insert element 22A is secured in the cavity 110A and is laterally aligned with the guide passage, by means of one or more securing screws 122. The illustrated screw 122 passes through a relatively enlarged opening 123 in the left hand side wall of the body part 12C (as viewed in FIG. 9) and engages with a screw threaded opening in the flange 43A to draw the flange into firm contact with that left hand side wall. The clearances between the flange 43A and the body part 12C can be made very small if it is desired to isolate the exhaust chamber formed within the cavity 110A in a completed nozzle. Insert element 22A could have a flange at its upstream end similar to the flange 43A, and then similar support and securing screws could be provided to engage that upstream flange.

It will be appreciated that the infeed grooves 64A (FIG. 5) and 64B (FIG. 6) are relatively easy to form accurately and could be provided directly in the correspondingly modified body part 12A or 12B instead of in a separate insert as illustrated.

FIG. 10 illustrates yet a further modification of FIG. 6 at the infeed end of the nozzle. The view shown in FIG. 10 corresponds with that shown in FIG. 5, i.e. the nozzle is shown in a closed position with the body parts 10D and 12D engaging each other on the contact plane 76. Again, the same numerals have been used as far as possible to indicate the same parts. In FIG. 10, however, there is no thread infeed insert assembly, the thread infeed passage 64B being formed directly in the body part 12D, i.e. the cavity 112 shown in FIG. 6 is eliminated. The control of inflow of treatment fluid is once again effected by a single, tubular flow control element 124 which is of complex construction relative to the simple tube 100 shown in FIG. 5, and which will be described further below.

Element 124 is mounted in a cavity 87A similar to the cavity 87 of FIG. 5 but provided directly in the body part 10D. Element 124 projects into a bore 94A which provides a communication passage leading from the lower end of the cavity to the groove 60A. Bore 94A is of relatively small cross section relative to the cavity, so that an annular surface 126 is left at the lower end of the cavity. Supply of treatment fluid to the cavity is effected via a supply passage 86A suitably formed in the body part 10D. At its upper end, cavity 87A provides an access opening onto the end face of body part 10D, which opening is screw threaded to receive closure screw 89A. In this embodiment, therefore, the receiver element, receiving the flow control element 124, is the body part 10D itself.

Flow control element 124 (best seen in FIG. 11) comprises a tubular body portion 128 having an enlarged end portion 130 at its upstream end and a flange 132 adjacent but spaced from the end portion 130. As illustrated, the enlarged end 130 and flange 132 are integral with the body 128, but they could each be formed separately and secured to the body if required. The external diameter of portion 130 is such that it can be inserted into one end of a spiral spring 134 (FIG. 10) so as to be gripped by the spring. Element 124 is forced into the spring until the latter engages one axial surface of flange 132. Spring 134 extends along the cavity 87A to engage with a guide projection 136 on the end of screw 89A. Spring 134 is longer than cavity 87A, so that the spring provides an urging means producing an axial force urging flange 132 against surface 126. Contact between flange 132 and surface 126 is made by an axially projecting rim 138 formed on the flange. The flexibility of flange 132 is such that it can distort in response to unevenness of surface 126 under the force applied by spring 134 so as to ensure sealing contact of rim 138 with surface 126 on an annulus completely surrounding the entrance to bore 94A. The flange and spring together form a resilient securing means securing flow control element 124 in place.

Element 124 has a throughbore comprising a bore portion 140 of uniform circular cross-section merging with a tapering portion 142. This tapering formation, at least at the entrance, is preferred because it renders the flow control performance of the element less sensitive to damage or malformation of the flow control bore in the entrance region. Bore portion 140 of uniform cross-section actually controls the inflow of treatment fluid. For this purpose, the length l of this bore portion is preferably at least equal to and may desirably be up to three times, the diameter of that portion. The requirements regarding the angle between tube 128 and thread infeed passage 64B are the same as those described above for the tube 100 and thread infeed passage 64A. Flow control element 124 could of course be used in a suitably modified embodiment of FIG. 5.

When closure screw 89A is removed, spring 134 can be withdrawn from cavity 87A and will simultaneously withdraw flow control element 124 because of the gripping contact between the spring and end portion 130. Spring 134 may also be suitably secured to closure screw 89A for removal therewith, but the securing arrangement should not cause rotation of the flow control element in the cavity in response to screwing or unscrewing of the closure 89A.

Thus, in this final embodiment, the design has been further substantially improved at the infeed end of the nozzle enabling both increased control over flow conditions within the nozzle, i.e. increased uniformity as between different nozzles and over time, and easier manufacture. The improvement has been carried to such a degree that the infeed insert assembly, which was essential in the embodiment of FIG. 3 to overcome wastage problems associated with manufacture of that design, can now be eliminated without thereby causing unacceptable wastage levels.

What is claimed is:

1. A thread testurizing nozzle for texturizing a thread travelling in a generally straight path, said nozzle comprising, means for bringing together a thread to be texturized and treatment fluid at a junction location on said path, said means including a thread infeed passage opening onto said junction location and a single fluid infeed passage extending along an axis inclined at a small angle to said thread infeed passage and debouching onto said junction location;

a texturizing chamber defining a section of said path downstream from said junction location relative to the direction of movement of the thread through the nozzle;

a perforated wall surrounding said chamber to permit fluid to pass out of said chamber in a direction transverse to said path; and a guide passage defining a section of said path between said junction location and said texturizing chamber, said thread infeed passage being offset transversely relative to said guide passage whereby said infeed passage and said guide passage have no common plane of symmetry so that the treatment fluid from said infeed passage urges the thread towards one side of said guide passage.

2. A thread texturizing nozzle as set forth in claim 1 wherein said guide passage widens in the downstream direction.

3. A nozzle as set forth in claim 2 wherein said guide passage widens smoothly in the downstream direction.

4. A nozzle as set forth in claim 3 wherein said guide passage widens uniformly in the downstream direction.

5. A nozzle as set forth in claim 3 or claim 4 wherein said guide passage widens from one end thereof to the other.

6. A nozzle as set forth in claim 5 wherein the degree of widening, expressed as a percentage of the length of said guide passage, lies between 0 and 1%.

7. A thread texturizing nozzle for texturizing a thread travelling in a generally straight path, said nozzle comprising means for bringing together a thread to be texturized and treatment fluid at a junction location on said path, said means including a thread infeed passage opening onto said junction location, and a tube having an open-ended bore defining a single fluid infeed passage extending along an axis inclined at a small angle to said thread infeed passage and debouching onto said junction location;

a texturizing chamber defining a section of said path downstream from said junction location relative to the direction of movement of the thread through the nozzle;

a perforated wall surrounding said chamber to permit fluid to pass out of said chamber in a direction transverse to said path;

a guide passage defining a section of said path between said junction location and said texturizing chamber; and securing means releasably securing said tube in a passage leading to said guide passage whereby all treatment fluid entering said guide passage flows through said tube.

8. A nozzle as set forth in claim 7 wherein said tube is removably mounted in said passage leading to said guide passage.

9. A nozzle as set forth in claim 7 wherein at least a portion of said open-ended bore is of uniform circular cross-section along the length, thereof, said length being at least equal to the diameter thereof.

10. A nozzle as set forth in claim 9 wherein another portion of said open-ended bore is of tapering cross-section, the smallest cross-section thereof merging into said portion of uniform cross-section.

11. A nozzle as set forth in any of claims 7 to 10 wherein said nozzle has a cavity receiving said securing means and providing an access opening, a removable closure closing said access opening, and a supply passage for treatment fluid debouching onto said cavity between said closure and said tube.

12. A nozzle as set forth in claim 7 comprising two carrier members adapted to engage one another to enclose an open-ended elongated space containing said path, wherein one of said carrier members defines a receiver element receiving said tube and the other carrier member has a groove defining said thread infeed passage.

13. A nozzle as set forth in claim 7 comprising two carrier members adapted to engage one another to enclose an open-ended elongated space containing said path wherein an insert element is releaseably secured to at least one of said carrier members, said insert element lying within said space when said carrier members engage one another to define a receiver element receiving said tube, said thread infeed passage being disposed on the other carrier member.

14. A nozzle as claimed in claim 13 characterized in that said other carrier member carries an insert element having a groove defining said thread infeed passage.

15. A nozzle as set forth in claim 7 wherein said securing means comprises a flange on said tube, said flange being flexible to form a sealing contact with an abutment surface encircling said tube.

16. A nozzle as set forth in claim 15 wherein said flange is integral with said tube.

17. A nozzle as set forth in claim 15 wherein said securing means comprises urging means operable to exert a force on said flange to urge said flange towards said abutment surface.

18. A nozzle as set forth in claim 17 wherein said urging means comprises a spring.

19. A nozzle as set forth in claim 17 wherein said tube and said urging means are releasably connectable for mounting as a unit.

20. A thread texturizing nozzle as set forth in claim 7 wherein said guide passage widens in the downstream direction.

21. A nozzle as set forth in claim 20 wherein said guide passage widens from one end thereof to the other.

22. A nozzle as set forth in claim 21 wherein the degree of widening, expressed as a percentage of the length of said guide passage, lies between 0 and 1%.

23. A nozzle as set forth in claim 22 wherein said guide passage widens smoothly in the downstream direction.

24. A nozzle as set forth in claim 23 wherein said guide passage widens uniformly in the downstream direction.

25. A thread texturizing nozzle for texurizing a thread travelling in a generally straight path, said nozzle comprising means for bringing together a thread to be texturized and a treatment fluid at a junction location on said path;

a texturizing chamber defining a section of said path downstream from said junction location relative to the direction of movement of the thread through the nozzle;

a perforated wall surrounding said chamber to permit fluid to pass out of said chamber in a direction transverse to said path;

a guide passage defining a section of said path between said junction location and said texturizing chamber;

at least two carrier members adapted to engage one another to enclose an open-ended elongated space containing said path, at least one insert element releaseably secured to each respective carrier member to lie within said space when said carrier members engage one another, each element having a wall portion extending along said path and joined to at least one outwardly projecting support position which engages a support surface of the associated carrier member within said space to hold said wall portion spaced from said carrier member, said elements co-operating to define said texturizing chamber between said wall portions and an exhaust chamber outside said wall portions, and said wall portions having perforations providing communication between said texturizing chamber and said exhaust chamber; and adjusting means operable to adjust the location of at least one insert element relative to a respective carrier member.

26. A nozzle as set forth in claim 25 wherein each support portion in each insert element is a flange.

27. A nozzle as set forth in claim 25 wherein said adjusting means comprises a screw mounted in a respective carrier member and engaging said insert element.

28. A nozzle as set forth in claim 25 wherein at least one of said carrier members has an exhaust port communicating with said exhaust chamber to enable withdrawal of treatment fluid therefrom.

29. A thread texturizing nozzle as set forth in claim 25 which further comprises a second insert element releaseably secured to each respective carrier member to form an insert assembly defining a thread infeed section of said path upstream of and opening into said junction location.

30. A thread texturizing nozzle for texturizing a thread travelling in a generally straight path, said nozzle comprising means for bringing together a thread to be texturized and a treatment fluid at a junction location on said path, a texturizing chamber defining a section of said path downstream from said junction location relative to the direction of movement of the thread through the nozzle;

a perforated wall surrounding said chamber to permit fluid to pass out of said chamber in a direction transverse to said path, at least two carrier members each adapted to engage one another to enclose an open-ended elongated space containing said path;

a plurality of insert elements releasably secured to each respective carrier member and lying within said space when the carrier members engage one another, first insert elements of said plurality cooperating with each other to form a first insert assembly defining a thread infeed section of said path upstream of and opening onto said junction location;

second insert elements of said plurality cooperating with each other to form a guide passage between said junction location and said texturizing chamber; and further insert elements of said plurality cooperating with each other to form a further insert assembly defining said texturizing chamber.

31. A thread texturizing nozzle in which thread can be texturized while moving along a generally straight path through the nozzle, the nozzle comprising means to bring together a thread to be texturized and a texturizing fluid at a junction location on said path, a texturizing chamber spaced along said path downstream from said junction location considered in the direction of movement of the thread through the nozzle and having a perforated wall to permit fluid to pass out of the chamber in a direction transverse to the path, and a guide passage extending along said path between said junction location and said texturizing chamber, said means to bring together thread and fluid comprising a thread infeed passage opening onto said junction location and generally aligned with said guide passage and a single fluid infeed passage extending along an axis inclined at a small angle to the thread infeed passage and debouching onto said junction location, said fluid infeed passage being provided by a receiver element having a through way, a tube having an open-ended bore forming said infeed passage and means releasably securing said tube in said through way of the receiver element.

32. A nozzle as claimed in claim 31 wherein said tube is removably mounted in said through way of said receiver element by means of said securing means.

33. A nozzle as claimed in claim 31 wherein a closure is provided for the end of the throughway remote from the junction location and an additional flow passage for texturizing fluid debouches onto said throughway between the closure and the tube.

34. A thread texturizing nozzle for texturizing a thread travelling in a generally straight path, said nozzle comprising means for bringing together a thread to be texturized and a treatment fluid at a junction location on said path;

a texturizing chamber defining a section of said path downstream from said junction location relative to the direction of movement of the thread through the nozzle;

a perforated wall surrounding said chamber to permit fluid to pass out of said chamber in a direction transverse to said path;

a guide passage defining a section of said path between said junction location and said texturizing chamber;

at least two carrier members adapted to engage one another to enclose an open-ended elongated space containing said path, at least one insert element releaseably secured to each respective carrier member to lie within said space when said carrier members engage one another, each element having a wall portion extending along said path and joined to at least one outwardly projecting support portion which engages a support surface of the associated carrier member within said space to hold said wall portion spaced from said carrier member, said elements co-operating to define said texturizing chamber between said wall portions and an exhaust chamber outside said wall portions, and said wall portions having a plurality of longitudinally extending slots providing communication between said texturizing chamber and said exhaust chamber.

35. A nozzle as set forth in claim 34 wherein each slot extends from one axial end face of a respective insert element to the other.

36. A nozzle as set forth in claim 34 wherein the number of slots is selected from the range 10 to 14, and the slots are equiangularly spaced about said path.

37. A nozzle as set forth in claim 34 wherein said insert elements define a longitudinally extending slot at each interface thereof to provide communication between said texturizing chamber and said exhaust chamber.

* * * * *

UNITED STATES PATENT AND TRADEMARK OFFICE

CERTIFICATE OF CORRECTION

PATENT NO. : 4,453,298

DATED : June 12, 1984

INVENTOR(S) : Nabulon, Werner et al

It is certified that error appears in the above-identified patent and that said Letters Patent is hereby corrected as shown below:

Column 2, line 24, change "chember" to chamber.

Column 4, line 19, change "20" to 10.

Column 5, line 15, change "34" to 24.

Signed and Sealed this

*Twenty-third* Day of *October 1984*

[SEAL]

*Attest:*

GERALD J. MOSSINGHOFF

*Attesting Officer*

*Commissioner of Patents and Trademarks*